US007887404B2

(12) United States Patent
Saffari et al.

(10) Patent No.: US 7,887,404 B2
(45) Date of Patent: Feb. 15, 2011

(54) LOTTERY AND GAMING SYSTEMS WITH SINGLE REPRESENTATION FOR MULTIPLE INSTANT WIN GAME OUTCOMES

(75) Inventors: Ali Saffari, Reno, NV (US); Bryan Wolf, Reno, NV (US)

(73) Assignee: IGT, Reno, NV (US)

( * ) Notice: Subject to any disclaimer, the term of this patent is extended or adjusted under 35 U.S.C. 154(b) by 969 days.

(21) Appl. No.: 11/044,784

(22) Filed: Jan. 27, 2005

(65) Prior Publication Data

US 2006/0166725 A1 Jul. 27, 2006

(51) Int. Cl.
*A63F 9/24* (2006.01)

(52) U.S. Cl. ..... 463/16

(58) Field of Classification Search ..... 463/2, 463/16–19, 25, 40–42; 235/375, 381; 273/138.1, 273/143 R, 121 B See application file for complete search history.

(56) References Cited

U.S. PATENT DOCUMENTS

| | | | | |
|---|---|---|---|---|
| 4,157,829 A | | 6/1979 | Goldman et al. | 273/138 A |
| 4,339,798 A | | 7/1982 | Hedges et al. | 364/412 |
| 4,467,424 A | | 8/1984 | Hedges et al. | 364/412 |
| 4,494,197 A | | 1/1985 | Troy et al. | 364/412 |
| 4,582,324 A | * | 4/1986 | Koza et al. | 463/16 |
| 4,652,998 A | | 3/1987 | Koza et al. | 364/412 |
| 4,689,742 A | | 8/1987 | Troy et al. | 364/412 |
| 4,817,951 A | | 4/1989 | Crouch et al. | 273/143 R |
| 4,856,787 A | | 8/1989 | Itkis | 273/237 |
| 4,982,337 A | | 1/1991 | Burr et al. | 364/479 |
| 5,042,809 A | * | 8/1991 | Richardson | 463/18 |

(Continued)

OTHER PUBLICATIONS

U.S. Appl. No. 10/940,272 filed Sep. 14, 2004, and listing John W. Chamberlain, Ali Saffari, Bryan Wolf and Ted Gail as inventor (107 pages).

(Continued)

*Primary Examiner*—Peter DungBa
*Assistant Examiner*—Masud Ahmed
(74) *Attorney, Agent, or Firm*—Weaver Austin Villeneuve & Sampson LLP

(57) ABSTRACT

The invention is directed to a gaming network and a method for conducting an electronic wagering game, such as a pull-tab game or other instant win game, having a finite pool of outcome records from which outcomes are selected for the players. The method may include receiving value from a player, receiving game option selections for the wagering game from the player, and selecting a plurality of outcome records for the wagering game from the finite pool of outcome records for the wagering game based on the game option selections from the player. The method may further include determining whether each selected outcome record is a winning outcome or a losing outcome for the wagering game, and displaying the outcomes of the plurality of selected outcome records to the player in a single graphical outcome presentation. In one embodiment, the outcome presentation may be in the form of a printed ticket printed at a player terminal unit and presenting information relating to the outcomes selected for the player. In another embodiment, the outcome presentation may be in the form of a video display at a player terminal unit providing a graphical presentation of information relating to the selected outcomes, such as the display of a single outcome of a second wagering game corresponding to the selected outcomes of the wagering game.

38 Claims, 8 Drawing Sheets

U.S. PATENT DOCUMENTS

| | | | | | |
|---|---|---|---|---|---|
| 5,092,598 | A | | 3/1992 | Kamille | 273/139 |
| 5,324,035 | A | * | 6/1994 | Morris et al. | 463/42 |
| 5,348,299 | A | | 9/1994 | Clapper, Jr. | 273/138 A |
| 5,377,975 | A | | 1/1995 | Clapper, Jr. | 273/138 A |
| 5,487,544 | A | | 1/1996 | Clapper, Jr. | 273/138 A |
| 5,536,008 | A | | 7/1996 | Clapper, Jr. | 463/16 |
| 5,562,284 | A | | 10/1996 | Stevens | 273/139 |
| 5,580,311 | A | | 12/1996 | Haste, III | 463/29 |
| 5,595,538 | A | | 1/1997 | Haste, III | 463/17 |
| 5,645,485 | A | | 7/1997 | Clapper, Jr. | 463/17 |
| 5,657,899 | A | | 8/1997 | Stoken | 221/1 |
| 5,735,432 | A | | 4/1998 | Stoken et al. | 221/1 |
| 5,749,784 | A | | 5/1998 | Clapper, Jr. | 463/17 |
| 5,810,664 | A | | 9/1998 | Clapper, Jr. | 463/17 |
| 5,871,398 | A | | 2/1999 | Schneier et al. | 463/16 |
| 5,915,588 | A | | 6/1999 | Stoken et al. | 221/2 |
| 5,928,082 | A | | 7/1999 | Clapper, Jr. | 463/16 |
| 5,941,771 | A | | 8/1999 | Haste, III | 463/17 |
| 5,944,606 | A | | 8/1999 | Gerow | 463/27 |
| 5,949,042 | A | * | 9/1999 | Dietz et al. | 235/375 |
| 5,980,385 | A | * | 11/1999 | Clapper, Jr. | 463/17 |
| 6,024,640 | A | * | 2/2000 | Walker et al. | 463/17 |
| 6,056,289 | A | | 5/2000 | Clapper, Jr. | 273/138.2 |
| 6,168,521 | B1 | | 1/2001 | Luciano et al. | 463/18 |
| 6,183,361 | B1 | | 2/2001 | Cummings et al. | 463/18 |
| 6,309,298 | B1 | | 10/2001 | Gerow | 463/20 |
| 6,368,218 | B2 | | 4/2002 | Angell, Jr. | 463/40 |
| 6,524,184 | B1 | | 2/2003 | Lind et al. | 463/13 |
| 6,537,150 | B1 | * | 3/2003 | Luciano et al. | 463/16 |
| 6,599,187 | B2 | | 7/2003 | Gerow | 463/17 |
| 6,656,040 | B1 | * | 12/2003 | Brosnan et al. | 463/16 |
| 6,869,358 | B2 | * | 3/2005 | Yacenda | 463/17 |
| 7,416,484 | B1 | * | 8/2008 | Nelson et al. | 463/25 |
| 2001/0003100 | A1 | * | 6/2001 | Yacenda | 463/41 |
| 2002/0098882 | A1 | | 7/2002 | Lind et al. | 463/17 |
| 2002/0107065 | A1 | | 8/2002 | Rowe | 463/20 |
| 2002/0111214 | A1 | | 8/2002 | Lind et al. | 463/42 |
| 2002/0132661 | A1 | | 9/2002 | Lind et al. | 463/19 |
| 2003/0186734 | A1 | | 10/2003 | LeMay et al. | 463/16 |
| 2004/0014514 | A1 | * | 1/2004 | Yacenda | 463/17 |
| 2005/0059468 | A1 | | 3/2005 | Cannon | 463/19 |
| 2005/0064931 | A1 | * | 3/2005 | Lathrop et al. | 463/17 |

OTHER PUBLICATIONS

U.S. Appl. No. 10/937,989 filed Sep. 10, 2004, and listing Binh T. Nguyen, James Stockdale, Craig A. Paulsen and David H. Muir as inventors (66 pages).

International Preliminary Report on Patentability (counterpart PCT application).

International Search Report, International Application No. PCT/US2006/002430, mailed May 24, 2006.

Written Opinion of the International Searching Authority, mailed May 24, 2006.

Chinese Office Action dated Feb. 5, 2010 from Application No. 200680003373.8.

* cited by examiner

LOTTERY AND GAMING SYSTEMS WITH SINGLE REPRESENTATION FOR MULTIPLE INSTANT WIN GAME OUTCOMES

BACKGROUND

This invention relates to lottery systems for conducting pull-tab and other instant win lottery games and, more particularly, to gaming systems having pull-tab or other instant win lottery games with multiple outcomes being displayed to the players in a single graphical or printed representation.

Various lottery and gaming systems are known for conducting electronic instant win games and other wagering games, and for determining outcomes of wagering games by selecting predetermined outcomes from a finite pool of outcomes for the wagering game. U.S. Pat. No. 5,324,035 to Morris et al. discloses a gaming system including a central game processor, a plurality of master processing units and a plurality of slave terminals operable by players to play the game. The central game processor communicates with the master processing units and supplies the various games available in the system. The master processing units store and administer the games as they are played on the slave terminals connected to each respective master processing unit. A preferred game includes a fixed pool of game plays and a predetermined number of winning plays within each pool. Each player, through his or her slave terminal, can purchase plays in each fixed pool stored in the master processing unit to which that terminal is coupled. When a particular pool is exhausted, for example, through the purchase of all plays, the central game processor provides another fixed pool of plays to that master processing unit to enable continuous play.

U.S. Pat. No. 4,582,324 to Koza et al. discloses a video amusement game terminal for a gaming system for playing a game providing the illusion of skill. A game processor provides a video game presentation in response to player control wherein a prize award is disclosed through presentation of achievement by the player of a designated objective. The presentation provides to the player the illusion that the prize award is determined by player skill in achievement of the designated objective.

As another example, U.S. Pat. No. 5,042,809 to Richardson discloses a computerized gaming device and method of playing casino-type games of chance wherein a player chooses a game to play from a plurality of games displayed on a video screen. Each game has a finite number of chances per deal and a video display of the chances of winning when a deal is new, the percentage of winning chances remaining, the possible winning symbol combinations, and how many major winning chances remain. A displayed record is kept of the player's cash credit with a print out of wins and losses when he quits to claim any winnings. A provision is made to retire a deal or game whenever all the major winning chances have been won or when there are no more winning chances remaining. The player can quit at any time or call for a new deal screen after playing at least one chance in a deal.

U.S. Pat. No. 5,949,042 to Dietz, II, et al. discloses a multiple play gaming ticket, such as a pull-tab ticket or "instant winner" lottery ticket, and a coordinating validation system. In its preferred form, the pull-tab ticket has multiple groups or plays of indicia that each create an independent opportunity to win. To deter fraud, a validation code is provided which uniquely identifies the pull-tab ticket and is not merely a representation of the indicia. The pull-tab ticket is validated by a combination of a validator machine and a host computer. The validator machine reads the validation code and relays it the host computer to check for legitimacy (i.e., proper form and availability) and to correlate it to a stored record of gaming indicia. If approved, the host computer sends its record of gaming indicia back to the validator machine for display on monitor and payout, as appropriate.

As a further example, U.S. Pat. No. 6,024,640 to Walker et al. discloses an off-line remote lottery system that enables players to purchase instant-type lottery game outcomes from a randomized prize datastream in a central computer and view the outcomes on remotely disposed gaming computers that do not require an on-line connection to the central computer during play. The central computer stores identification data for a plurality of gaming computers and is configured for randomly assigning outcomes from the randomized prize datastream to the gaming computers in response to purchase requests by players for a requested number of outcomes in each purchase request. Each gaming computer includes a game program in memory for execution on the gaming computer to generate games that yield the purchased outcomes or aggregate net payoff of the purchased outcomes, and a redemption function for generating a redemption request to cash-out winnings. The system enables outcome purchase and redemption of winnings to be effectuated directly with the central computer over a telephone network, or via a plurality of agent terminals located at various lottery retailers.

U.S. Pat. No. 6,656,040 to Brosnan et al. discloses a gaming machine displaying multiple game outcome presentations to one or more players playing the gaming machine. A player may initiate a new game on the gaming machine while the outcome of a previous game is being presented to the player. For a number of different games, two or more game outcomes may be presented simultaneously to the player on the gaming machine. The game outcome presentations for two or more of the games may appear to interact, but the game outcomes determined by the gaming machine are independent of one another and do not depend on the game outcome presentation. Many different combinations of games may be played simultaneously on the gaming machine.

SUMMARY OF THE INVENTION

In one aspect, the invention is directed to a player terminal unit for conducting an electronic wagering game in a gaming network having a plurality of player terminal units wherein each player may purchase a plurality of outcome records from a finite pool of outcome records for the wagering game. The player terminal unit may include an input device for inputting a plurality of input selections, a currency-accepting mechanism that may be capable of allowing a player to deposit a medium of currency, a display device and a controller operatively coupled to the input device, the currency-accepting mechanism and the display device. The controller may be programmed to allow the currency-accepting mechanism to accept a deposit of an amount of a medium of currency by a player at the player terminal unit, and to allow the input device to receive input for game option selections from a player to purchase outcomes for the wagering game. The controller may further be programmed to cause a selection device of the gaming network to select outcome records from the finite pool of outcome records corresponding to a number of outcomes requested by the player in response to receiving input for the game option selections by the player at the input device, to determine whether each of the selected outcome records corresponds to a winning outcome or a losing outcome, and to cause the display device to display the outcomes of the plurality of selected outcome records to the player in a single graphical outcome presentation.

In another aspect, the invention is directed to a method for conducting an electronic wagering game at a gaming network. The method may include receiving value from a player, receiving game option selections for the wagering game from the player, and selecting a plurality of outcome records for the wagering game from a finite pool of outcome records for the wagering game based on the game option selections from the player. The method may further include determining whether each selected outcome record is a winning outcome or a losing outcome for the wagering game, and displaying the outcomes of the plurality of selected outcome records to the player in a single graphical outcome presentation.

In a further aspect, the invention is directed to a player terminal unit for conducting an electronic wagering game in a gaming network having a plurality of player terminal units wherein each player may purchase a plurality of outcome records from a finite pool of outcome records for the wagering game. The player terminal unit may include a currency-accepting mechanism that is capable of allowing a player to deposit a medium of currency, wherein a player may deposit an amount of the medium of currency to purchase outcomes for the wagering game, an input device for inputting a plurality of input selections, wherein the input device may receive input for game option selections from the player to purchase outcomes for the wagering game, a display device and a controller operatively coupled to the input device, the currency-accepting mechanism and the display device. The controller may cause a selection device of the gaming network to select outcome records from the finite pool of outcome records corresponding to a number of outcomes requested by the player in response to the input of game option selections by the player at the input device. The controller may also determine whether each of the selected outcome records corresponds to a winning outcome or a losing outcome, and cause the display device to display the outcomes of the selected outcome records to the player in a single graphical outcome presentation.

Additional aspects of the invention are defined by the claims of this patent.

DETAILED DESCRIPTION OF VARIOUS EMBODIMENTS

Figure 1:
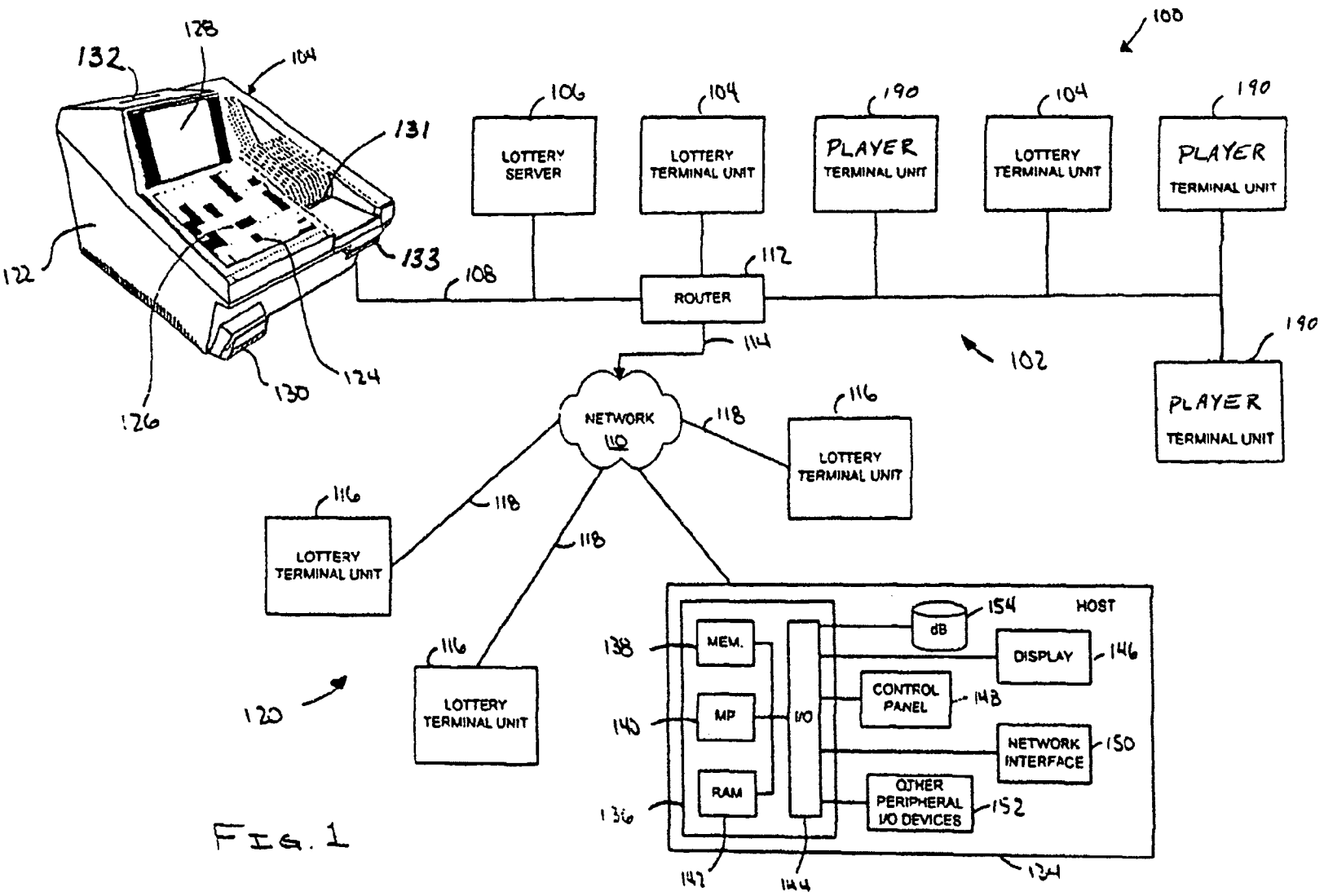
FIG. 1 is a block diagram of an embodiment of a networked lottery system.

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

An electronic pull-tab or other instant win game as described herein may have application in lottery systems, casino gaming systems and in other systems wherein an instant win game may be integrated into the existing functionality of the system. An instant win game may be provided in addition to a lottery or casino game, and may be provided for no additional charge or for an additional wager placed by the lottery or casino player. Typical instant win games, such as scratch-off games, are based on multi-tier probability tables wherein each possible winning result for the game occurs in a predetermined percentage of all outcomes of the instant win game. For example, in a given instant win game, for a $1.00 wager the probability of having a $1.00 winning outcome may be 1 in 10 occurrences of the instant win game, while the probability of having a $100 winning outcome is significantly lower, such as 1 in 500 occurrences of the instant win game. These types of games typically have a finite pool of outcomes, with a know number of winning outcomes for each prize level. In this way, the amounts of the sales, prize distribution and profit are known to the sponsor at the time of the game's offering.

Traditionally, pull-tab and other instant win lottery games are offered on paper or cardboard tickets sold over-the-counter by sales agents at retail sales locations such as gas stations, convenience stores, beverage stores, grocery stores and the like, or from vending machines that may be located at these or other locations. It may be desired to automate the instant win lottery games by integrating the games into existing networks for conducting lotteries or other gaming. By doing so, the game's sponsor may be able to reduce some of the labor and costs associated with making, distributing and selling the tickets, and to enhance the entertainment value to the players through the use of graphics and other capabilities of an automated system.

In one embodiment, players may purchase and/or play one or more outcomes for an electronic pull-tab or instant win lottery game, and the outcomes of the instant win game may be printed on a single ticket, multiple outcomes may be presented to the players in a single graphical representation, or both. Instead of receiving individual physical tickets for each occurrence of the instant win game, a plurality of outcomes may be played at a terminal unit, with the terminal unit or other device of the lottery or gaming network executing the occurrences of the game instead of having the players physically pull tabs or scratch off covering material to reveal the outcomes. After executing the occurrences of the instant win game, the terminal units may print a single ticket with information regarding all the outcomes purchased by the player. The printed ticket may include a line for each outcome, may provide a line for each winning outcome and a summary of the losing outcome, or may provide more detailed information for each winning outcome, or may otherwise provide information for the players regarding the instant win game outcomes purchase by the player. Moreover or alternatively, the terminal units may display a graphical representation of the instant win game outcomes purchased by the players. The graphical representation may include information in a format similar to that described for the multiple outcome tickets, or may include a single outcome, such as an outcome of another wagering game such as slots or video poker, corresponding to a plurality of outcomes of the instant win game. For the wagering game outcome display, multiple instant win game outcomes may be accumulated by the terminal unit, may be mapped to a single outcome of the other wagering game, and displayed to the player in a manner simulating an occurrence of the other wagering game with the same outcome as the accumulated instant win game outcomes.

Lottery Network

FIG. 1 illustrates one possible embodiment of a lottery network 100 that may implement electronic instant win games in addition to normal lottery-type games. Referring to FIG. 1, the lottery network 100 may include a first group or network 102 of lottery terminal units 104 operatively connected to a lottery network computer or server 106 via a network data link or bus 108. The lottery network 100 may be coupled to a network 110, which may be, for example, the Internet, a wide area network (WAN), or a local area network (LAN) through a network hub or router 112 via a first network link 114. In one possible configuration, the first network 102 may be a state lottery system operating within an individual state or region of states. In this configuration, the individual lottery terminal units 104 may be interconnected to a central system for tracking and coordination of the state lottery system, including issued tickets, drawn numbers, and/or amounts waged.

The lottery network 100 may further include other lottery terminal units 116 that may be directly connected to the network 110 through a plurality of direct network links 118, thereby eliminating the need for the bus 108, router 112 or other networking equipment. Each lottery terminal unit 116 in this configuration may represent a group of lottery retailers participating in the state lottery, as described above, or a plurality of the lottery terminal units 116 may be grouped together to form a lottery node 120. The lottery nodes 120, in turn, may be directly connected and/or multiplexed to the network 110 via the direct network links 118. Further, the direct network links 118 may represent secure communications channels physically hardened against tampering and/or the communications may be encrypted to prevent unauthorized access to information transmitted thereon.

FIG. 1 further illustrates a perspective view of one possible embodiment of a lottery terminal unit 104. Although the following description relates to the design of the lottery terminal unit 104 depicted in FIG. 1, it should be understood that the lottery terminal units 106 and 116 may include similar features or may be configured with functionality to allow the entry of the information required for a player to participate in a lottery game. The exemplary lottery terminal unit 104 may include a housing or casing 122, and one or more input and output devices, which may be, among other things, a control panel 124 having a plurality of input keys 126, a display 128, a value input device such as a card reader 130, a lottery play slip or ticket reader 131, a lottery ticket printer 132, and an instant game card reader/writer 133. The lottery play slip reader 131 may be configured to read bar codes, user selections, magnetically stored information or any other desired input information or media used to encode information on a play slip or lottery ticket.

The input keys 126 may allow the player or sales agent to select the game to be played, input the value to be wagered, manually enter the selected lottery characters, and input any other information necessary to play a given lottery game. The display 128 may be a LCD, a CRT, a touch-screen capable of receiving and displaying information, or any other suitable device capable of displaying the information input via the input keys 126, the lottery play slip reader 131 or the touch-screen input. The value input device may include any device that can accept value or a wager from a customer, such as the card reader 130 or an optical currency collector. The value input device may further be integrated with external devices, such as cash registers or other retail terminals, communicatively connected to the lottery terminal unit 104, to exchange information necessary to receive and record the wagering transactions. The lottery ticket printer 132 may be used to print or otherwise encode lottery tickets with information selected or required to play a given lottery game. Further, the lottery ticket printer 132 may provide lottery tickets, or even completed lottery slips if the selections were generated automatically, that could be used by the player in other lottery terminal units 116 equipped with lottery play slip or ticker readers 131.

The instant game card reader/writer 133 may be any device capable of receiving portable storage devices on which outcomes for an electronic instant win game is stored, and of reading information from and writing information to the storage media of the devices. An example of an instant win game wherein outcomes may be stored on a portable storage device for later redemption is disclosed in co-pending U.S. patent application Ser. No. 11/044,417 filed on Jan. 27, 2005, entitled "Lottery and Gaming Systems with Electronic Instant Win Games," the specification of which is expressly incorporated by reference herein. The instant win game outcomes may be stored on the portable storage device, the portable storage device may be dispensed or distributed to a player purchasing the outcomes, and the outcomes may be read from the portable storage device and displayed to the player at a redemption terminal unit. Where the instant win game is implemented on cardboard, plastic or other cards having magnetic strips for storing information, the reader/writer 133 may be card reader/writer capable of retrieving information from the magnetic strip of the card and writing information to the magnetic strip. If the cards are configured in a similar manner as standard credit cards, the card reader 130 and card reader/writer 133 may be implemented in a single card processing unit with the card processing unit and the controller 160 being configured to perform the necessary processing for credit cards, debit cards, and the cards for the instant win game, depending on the type of card disposed therein. Where the instant win game may be implemented on smart cards, the card reader/writer 133 may be a smart card processing unit capable of reading information from and writing information to a microchip, circuit or other processing mechanism disposed on or embedded in the smart card. Further, where the portable storage device is USB key chip or a portable flash memory, the reader/writer 133 may be a USB connection to which the key chip or flash memory may be attached such that the controller 160 may read information from and write information to the key chip or flash memory through the USB connector. Other types of portable storage devices and corresponding read/write units may be implemented in the lottery network 100 and are contemplated as having use with the present invention.

The lottery terminal units 104, 116 and lottery nodes 120 may include centralized or shared display mechanisms such as scrolling digital signs or message boards configured to display the outcome of a completed lottery game and advertise or attract players to upcoming games. In one exemplary configuration, at least one lottery terminal unit 104 or 116 includes software for generating graphics and is communicatively connected to an external LCD suitable for displaying graphics. Upon completion of a lottery drawing, the results or winning information can be formatted by the graphical software and displayed, in an eye-catching manner, on the external LCD. Alternatively, the graphical software may be stored on a peripheral device, such as a CD-ROM, and the result of the lottery drawing communicated thereto for formatting and display.

The network 110, and hence the individual lottery terminal units 104 and 116, may be communicatively connected to a central host computer 134. The central host computer 134 may be a single networked computer, or a series of interconnected computers having access to the network 110 via a gateway or other known networking system. Generally, the central host computer 134 may include a central lottery controller 136 configured to manage, execute and control the individual lottery elements 104, 116 and 120 and the routines used to play the various lottery games. The central lottery controller 136 may include a memory 138 for storing lottery programs and routines, a microprocessor 140 (MP) for executing the stored programs, a random access memory 142 (RAM) and an input/output bus 144 (I/O). The memory 138, microprocessor 140, RAM 142 and the I/O bus 144 may be multiplexed together via a common bus, as shown, or may each be directly connected via dedicated communications lines, depending on the needs of the lottery system 100.

Further, the central lottery controller 136 may be directly connected, hardwired, or indirectly connected through the I/O bus 144 to external components such as a display 146, a control panel 148, a network interface device 150 and other peripheral I/O devices 152. Examples of other peripherals device include, but are not limited to, storage devices, wireless adaptors, printers, and the like. In addition, a database 154 may be communicatively connected to the central lottery controller 136 and provide a data repository for the storage and correlation of information gathered from the individual lottery terminal units 104, 116 or lottery nodes 120. The information stored within the database 154 may be information relating to individual lottery terminal units 104, 116 such as terminal specific information like a terminal identification code, sales agent code, and location for each lottery ticket printed. The database 154 may further include ticket specific information such as the type of game played (Lotto, Pick-3, Pick-4, pull-tab, scratch off and the like), or game specific information such as the total lottery sales, drawing outcomes, amounts wagered, numbers selected by the players, and the like.

In operation, the central lottery controller 136 may operate as a clearing-house for the lottery terminal units 116 and the first lottery network 102, whereby the lottery network computer 106 collects, stores and analyzes status and operational information relating to each lottery terminal unit 104. For example, the lottery network computer 106 may continuously receive transactional data from the individual lottery terminal unit 104 indicative of the number of tickets sold and associated dollar amounts, and the lottery numbers and number order generated at each lottery terminal unit. The transactional data collected by the lottery network computer 106 may be communicated to the central host computer 134 continuously or may be processed into a batch format and transmitted periodically for storage in the database 154. If, for example, the central lottery controller 136 and the lottery network computer 106 are communicating continuously, it may be desirable for the central lottery controller 136 to execute the actual lottery routine and transmit the results to the lottery network computer 106 for distribution to the lottery terminal units 104 and directly to the lottery terminal units 116. In addition, it may be desirable for the central lottery controller 136 to include, via the peripheral device input 152, a scanner, such as the lottery play slip reader 132, for directly importing/reading manual selections into the database 154.

It will be understood that the lottery network 100 illustrated in FIG. 1 may alternatively represent the network layout within a gaming establishment providing a lottery-type game. In this alternate configuration, each stand-alone lottery terminal unit 104 may be an interactive player terminal capable of playing a variety of lottery or casino games, such as a lottery game, Keno, Bingo, video poker, video blackjack, slots, and the like. The lottery terminal units 104 may be distributed throughout a single gaming establishment or casino and connected with a LAN, or throughout multiple casino sites and connected with a WAN. Further, the LAN and/or WAN connecting each of the lottery terminal units 104 may include one or more separate and secure buses 108, routers 112, web servers, gateways and other networking equipment to provide continuous and/or redundant connectivity to the network 110. The network 110, configured in this manner, provides a system for players to participate collectively in a centralized lottery-type game. Further, the network 110 may include express gaming stations at which players may generate predefined or automatically selected lottery tickets simply by making a selection and a wager. As discussed above, the network 110 may be communicatively connected to the central host computer 134, the central lottery controller 136, and the database 142 to allow for implementation, storage, tracking and analysis of the lottery game.

Lottery Sales Terminal Unit

Figure 2:
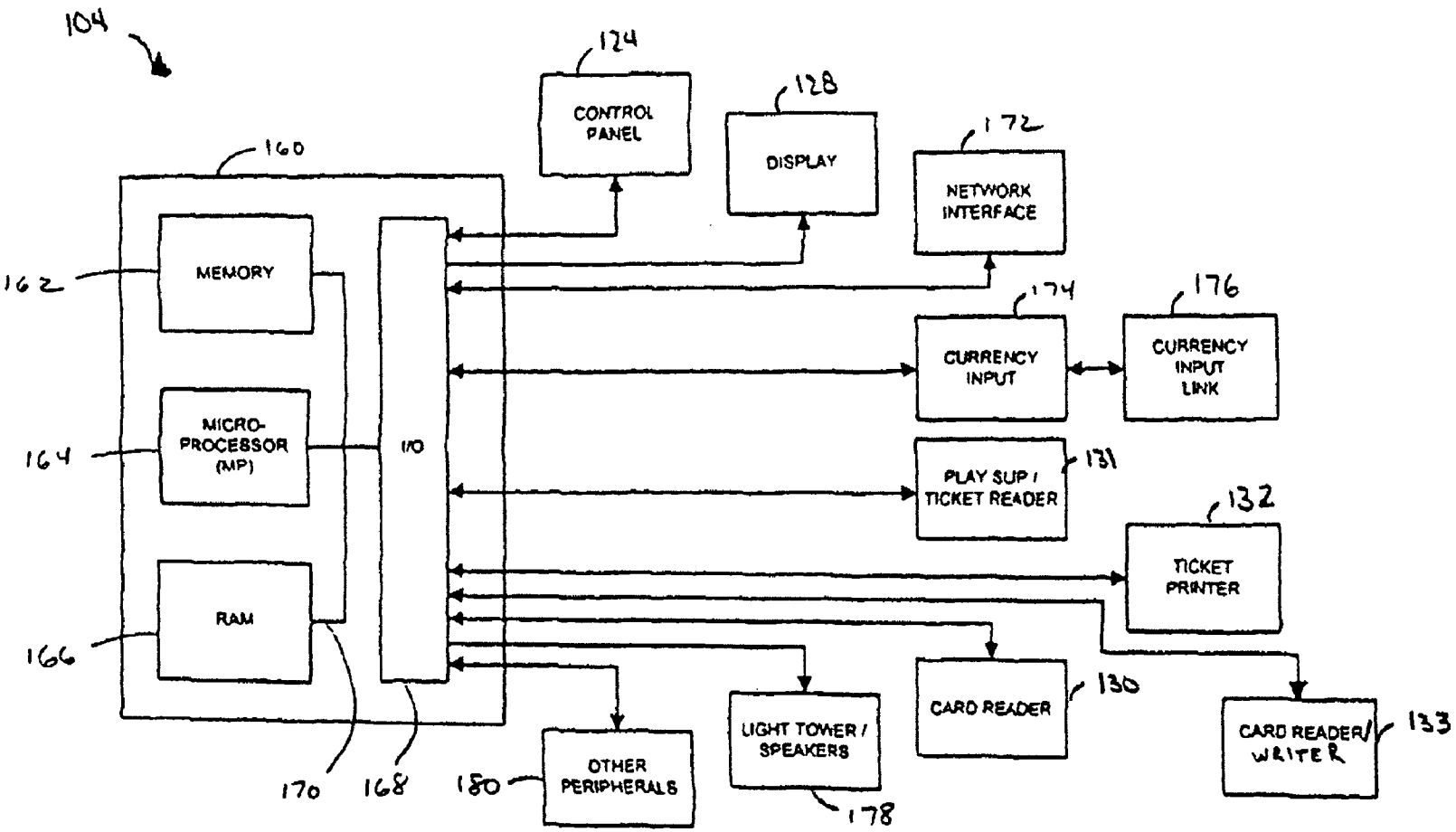
FIG. 2 is a block diagram of the electronic components of an embodiment of the lottery terminal unit shown in FIG. 1.

FIG. 2 illustrates a block diagram of an embodiment of the internal electronic components of the lottery sales terminal unit 104. The lottery sales terminal unit 116 may have the same or a different design, but may be configured to receive player entries into the lottery games and process winning lottery tickets. Referring to FIG. 2, the exemplary lottery terminal unit 104 may include a number of internal components such as a controller 160 having a program memory 162, a microcontroller or microprocessor (MP) 164, a random access memory (RAM) 166, and an input/output (I/O) bus 168, all of which may be interconnected via an address or data bus 170. It should be understood that while only one microprocessor 164 is shown herein, the controller 160 may be designed to support multiple microprocessors 164 arranged to operate in parallel or in any other known configuration. Similarly, the controller 160 may include multiple, and even redundant, program memories 162 and random access memories 166 to increase expandability, capacity and/or processing speed. The multiple processor and memory configurations may be used, for example, to isolate the individual lottery functions such as basic lottery operation, random number generation, information tracking, and the like. Although the I/O bus 168 is shown as a single addressable and integral block, it should be understood that direct I/O connections may be made, as well as any other desired I/O connection scheme. The program memory 162 and random access memory 166 may be implemented as a solid-state memory, an integrated circuit, a magnetically readable memory, and/or optically readable memories. Further, the program memory 162 may be read only memory (ROM) or may be read/write memory such as a hard disk. In the event that a hard disk is used as the program memory, the data bus 170 may comprise multiple address/data buses, which may be of differing types, and there may be a separate I/O circuit between the data buses.

FIG. 2 schematically illustrates that the controller 160 may be communicatively connected to the control panel 124, the display 128, the card reader 130, the lottery play slip or ticket reader 131, the lottery ticket printer 132, and the card reader/writer 133. The controller 160 may further be communicatively connected to a network interface card (NIC) or device 172, a currency input device 174 including a currency input link 176, and a light and speaker link 178. The network interface card 172 may be configured to allow the lottery terminal unit 104 to communicate information with other networked devices similarly connected to the network 110 using any known protocol or standard suitable for a lottery or network application. The currency input device 174 may be any kind of value input device such as the card reader 130 discussed above and/or bill and coin acceptors, or may include a currency input link 176 communicatively connected to a cash register (not shown) or other device for tracking and/or totaling currency or transactions. The light and speaker link 178 may be used to integrate visual and/or audio displays into the design of the lottery terminal unit 104.

FIG. 2 illustrates the components 124, 128-133, 162-166 and 172-180 directly connected the I/O bus 168 via dedicated circuits or conductors. However, it will be understood that different connections schemes may be used. For example, some of the components requiring limited communications with the controller 160 may be communicate via an auxiliary I/O bus (not shown) in a scheduled manner, while other components requiring fast communications or large data transfers may be directly connected to the I/O bus 168. Furthermore, depending on the needs of the system, some of the components may be directly connected to the microprocessor 164 without having to pass through the I/O bus 168.

Player Terminal Unit

Figure 3:
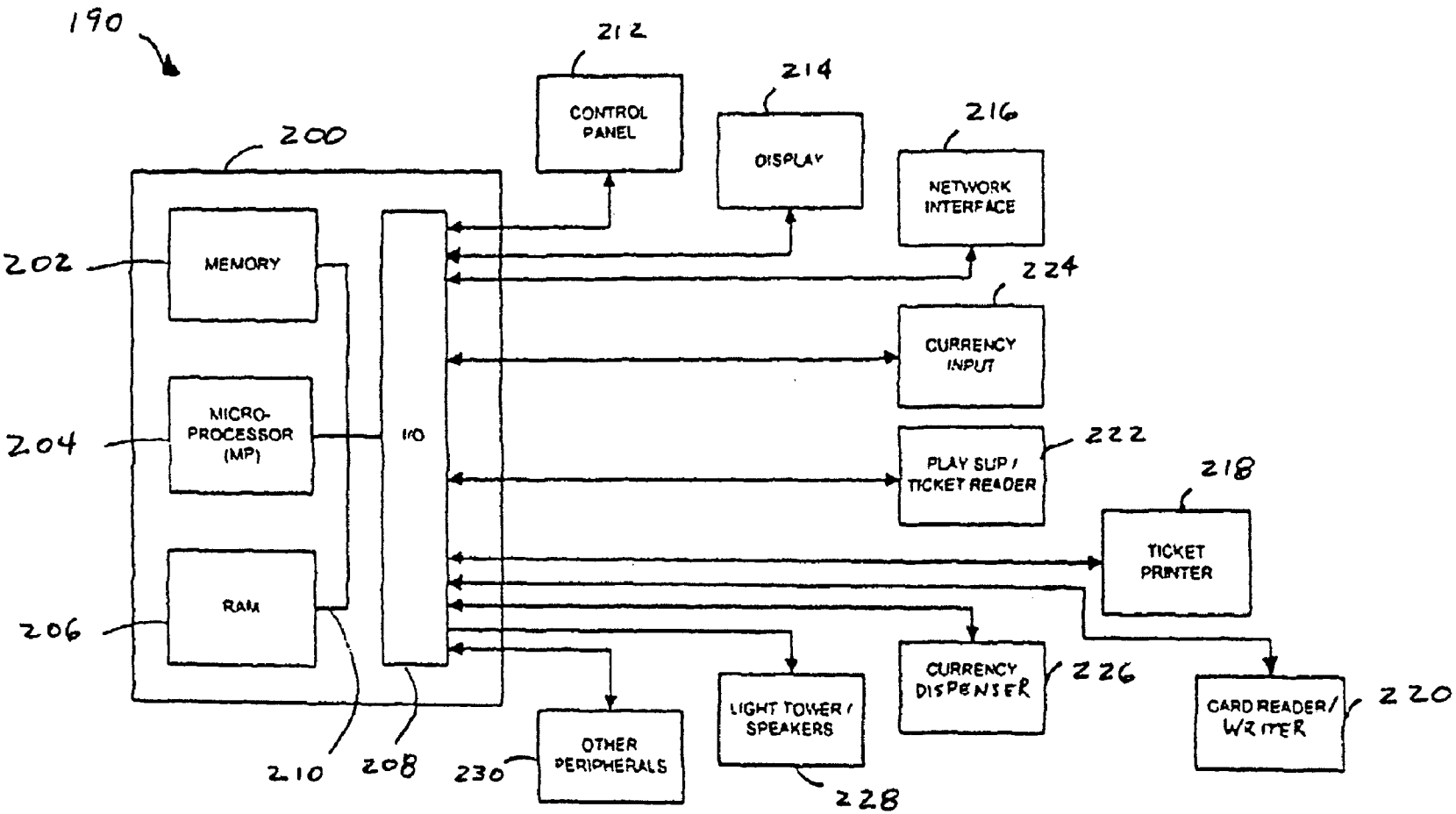
FIG. 3 is a block diagram of the electronic components of an embodiment of the player terminal unit shown in FIG. 1.

Returning to FIG. 1, the lottery network 100 may further include a plurality of player terminal units 190 at which players may purchase instant win game chances and play the instant win game. The players may input value at the player terminal units 190, and have the outcomes selected and presented at the terminal unit 190. In addition, where offered, players may insert or otherwise attach the portable storage device as discussed in the aforementioned patent application and redeem the outcomes of the instant win game stored thereon. The player terminal units 190 may be stand alone terminals or kiosks that may be approached and operated by the players without the necessity of a separate operator or agent of the sponsor, and may be placed in numerous locations within the area in which the instant lottery game is offered. FIG. 3 illustrates a block diagram of an embodiment of the internal electronic components of the player terminal unit 190. The exemplary player terminal unit 190 may include a number of internal components similar to those described for the lottery sales terminal units 104, 116 and the central host computer 134, such as a controller 200 having a program memory 202, a microcontroller or microprocessor (MP) 204, a RAM 206, and an I/O bus 208, all of which may be interconnected via an address or data bus 210. The controller 200 may be designed to support multiple microprocessors 204 arranged to operate in parallel or in any other known configuration, and may include multiple, and even redundant, program memories 202 and random access memories 206 as previously discussed in relation to controllers 136, 160, and the I/O bus 208 may have direct I/O connections or any other desired I/O connection scheme. The program memory 202 and random access memory 206 may be implemented using any appropriate storage technology such as, for example, those previously described herein.

FIG. 3 schematically illustrates that the controller 200 may be communicatively connected to a control panel 212, a display 214, a network interface card or device 216, a ticket printer 218, a card reader/writer 220, a play slip/ticket reader 222, a currency input 224, a currency dispenser 226, lights and speakers 228 and other peripherals 230 in a similar manner as previously described for the sales terminal units 104. The components 212-230 may be similar in configuration and operation as similar components previously described, and may be configured in any manner necessary for redemption of the outcomes of the instant win game by the player. For example, the control panel 212 may include the necessary input devices to allow the player to enter information for playing the instant win game and/or redeeming the outcomes, such as input selections necessary to purchase and select outcomes for the instant win game and to have the outcomes displayed at the display 214. As an alternative or a supplement for inputting information at the redemption terminal unit 190, the display 214 may be a touch-screen monitor allowing players to touch designated areas of the display 214 to enter any necessary information, with the selections or other information input by the players being communicated to the controller 200. Moreover, players may be permitted to enter game selection information on play slips and insert the completed play slips into the play slip reader 222 for processing in a manner known in the art.

Because the players may purchase instant win game outcomes, and the outcomes may be evaluated and prizes may be determined and issued at the player terminal units 190, the units 190 may further include one or more currency inputs 224 for receiving value from the players and one or more currency dispensers 226 configured to dispense the awards for the instant win game to the players in a particular medium of currency. The currency inputs 224 may be similar to those disclosed for the currency inputs 174 of the lottery terminal units 104, and the currency dispenser 226 may be bill and/or coin dispenser from which paper and/or coin currency may be dispensed in an amount equal to the award won by the player. The currency dispenser 226 may alternatively be card reader and/or writer that may read a credit or debit card in order to credit the player's account with the award amount, or to update the smart card or other game card with a cash credit, or credits toward purchasing additional outcomes for the instant win game. As a further alternative, the currency dispenser 226 may be the ticket printer 218 or other printer that may print and dispense a voucher or receipt that may then be taken to a cashier or other sales agent, perhaps at one of the sales terminal units 104, to claim the cash amount of the game award.

FIG. 3 illustrates the components 202-206 and 212-230 directly connected the I/O bus 208 via dedicated circuits or conductors. However, it will be understood that different connections schemes may be used. For example, some of the components requiring limited communications with the controller 200 may be communicate via an auxiliary I/O bus (not shown) in a scheduled manner, while other components requiring fast communications or large data transfers may be directly connected to the I/O bus 208. Furthermore, depending on the needs of the system, some of the components may be directly connected to the microprocessor 204 without having to pass through the I/O bus 208.

Printing Multiple Instant Win Game Outcomes

Figure 4:
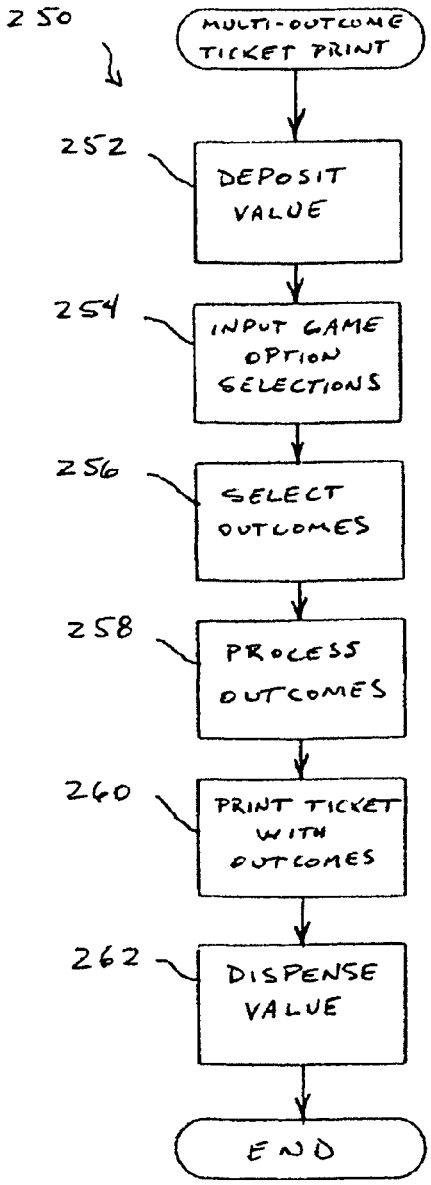
FIG. 4 is a flowchart of an embodiment of a multiple outcome ticket print routine for an electronic instant win game.

The process for purchasing instant win game outcomes and printing multiple outcomes on a single ticket will now be discussed with regard to the multi-outcome ticket print routine 250 illustrated in FIG. 4. For purposes example and explanation, the routine 250 is initially discussed using the embodiment of an instant win game wherein players may purchase and redeem or play instant win game outcomes at player terminal unit 190 in a single session and without the assistance or intervention of a sale agent for the game's sponsor. Embodiments wherein instant win game outcomes are purchased from sales agents and the instant win game outcomes are stored on portable storage devices will be discussed further below.

The multi-outcome ticket print routine 250 may begin at a block 252 wherein a player may deposit value at a currency input 224 of a player terminal unit 190 of the lottery network 100 in order to begin the process of purchasing instant win game outcomes. The value deposited to purchase the outcomes may be in any appropriate form to be accepted by the lottery network 100 in exchange for the purchased outcomes. For example, the value may be monetary in the form of paper or coin currency deposited at the player terminal unit 190 in the currency input 224 in the form of bill and/or coin acceptors, or credit or debit cards read by card reader 220. Alternatively, the lottery network 100 may be configured to provide player tracking functionality as is know in the art, which may include the provision of a drawing account with previously-deposited funds, electronic funds transfer, automated debiting of bank accounts or credit cards, or any other automated mechanism for obtaining value to pay for the purchased outcomes. The information may be accessed by the controller 200 in response to the player inserting a player tracking card at a device such as the card reader 220, or inputting player identification information at the control panel 212 or other input device. Still further, the value may be in the form of a voucher having a cash or credit value that may be read by the ticket reader 222, with the associated value being applied to the purchase of the game outcomes.

Once value is deposited at the player terminal unit 190 or the player otherwise initiates the purchase of instant win game outcomes, control may pass to a block 254 wherein the player at the player terminal unit 190 may input information for the game options for purchasing the type and amount of game outcomes desired by the player. The information may be input at the control panel 212 or other input device of the player terminal unit 190, such as by inserting a completed play slip into the play slip/ticket reader 222. Depending on the implementation of the instant win game(s) in the lottery network 100, the player may be provided with a plurality of options for purchasing instant win game outcomes. For example, players may be offered the opportunity to select one or more of a plurality of instant win games offered by the lottery sponsor and made available on the lottery network 100, to select a purchase denomination for an instant win game where a given instant win game is offered with differing denominations and corresponding award amounts, to select the number of outcomes of the instant win game to be purchased, and to make any other available selections. When the selections are entered, the controller 200 may validate the game option selections and cause the display 214 or other display device of the player terminal unit 190 to display the selections or a summary thereof to the player. The player terminal unit 190 may then provide the player with the option to modify the game option selections or confirm the existing selections.

In the illustrated embodiment, once sufficient value is deposited for the outcomes to be purchased and the game option selections are entered by the player, control may pass to a block 256 wherein the outcomes to be purchased and provided to the player may be selected from a pool or pools of available outcomes for the instant win game or games selected by the player. The outcomes may be selected from the pool randomly, sequentially or by any other desired method for selecting one or more outcomes from the pool. As previously discussed, each instant win game may have a finite pool of known outcomes including a predetermined combination of winning and non-winning outcomes that will yield a desired income and payout rate for the instant win game. The pool of outcomes for the instant win game may reside at any desired location or locations within the lottery network 100 such that the selected outcomes may be provided to the player lottery terminals 190 for sale to the players.

Many strategies for generating finite pools of outcomes for wagering games and distributing the outcomes to gaming units with a gaming network are known in the art. In a simple implementation, the finite pool of outcomes may be generated and stored at a central computer of the lottery network 100, with the central computer selecting the necessary number of outcomes from the pool in response to a request transmitted by one of the player terminal units 190, and transmitting the selected outcomes to the requesting player terminal unit 190. In other implementations, the outcome pools or portions of outcome pools may be distributed to host computers 134 and/or directly to the player terminal units 190 where the outcomes may be selected when requested.

One example of a gaming network wherein outcomes for a finite pool wagering game are distributed in a gaming network is disclosed in U.S. Pat. No. 5,324,035, issued on Jun. 28, 1994 to Morris et al., entitled "Video Gaming System with Fixed Pool of Winning Plays and Global Pool Access." Morris et al. discloses a gaming system including a central game processor, a plurality of master processing units and a plurality of slave terminals operable by players to play the game having a finite pool of outcomes. The central game processor communicates with the master processing units and supplies the various games available in the system, including fixed pools of outcomes. The master processing units store and administer the wagering games as they are played on the slave terminals corresponding to each respective master processing unit. Some of the wagering games include fixed pools of game outcomes and a predetermined number of winning outcomes within each pool. A player, through a slave terminal, can purchase plays in each fixed pool stored in the master processing unit to which that terminal is coupled. When a particular pool is exhausted, for example, through the purchase of all plays, the central game processor provides another fixed pool of plays to that master processing unit to enable continuous play. Other methods for distributing outcomes for the instant win games are known and will be apparent to those skilled in the art, and are contemplated as having use with the electronic instant win game in accordance with the present invention.

The outcome records for the instant win game stored and retrieved from the pools of outcomes may include the information necessary for conducting the electronic instant win game, and for ensuring the security and integrity of the game. The information relating to the actual outcome may be in any form necessary based on the configuration of the instant win game for storing the outcome and generating the outcome at the player terminal unit 190. For example, the information may correspond to the actual outcome of the instant win game, such as specifically indicating the game symbols or other game indicia for the outcome. Alternatively, the outcome information may be in the form of an outcome seed or other information as is known in the art that may be processed by the player terminal unit 190 to arrive at the outcome of the instant win game. In one embodiment, the outcome information may be a random number seed that may be used as input to corresponding random number generation software at the player terminal unit 190 that uses the random number outcome to generate the outcome for the instant win game. The use of the random number seeds and other coded information in the outcome record may improve the security of the game by making it more difficult to generate an outcome record outside the lottery network 100 that may be correctly processed by the lottery network 100. Other forms of outcome information for transmitting the outcome and performing processing to generate the outcome are known in the art and are contemplated as having use with the instant win game in accordance with the present invention.

The outcome records may include additional information for identification and security within the electronic instant win game. The records may include information relating to the instant win game to which the outcomes correspond, such as identification information for the instant win game, denomination information where the same instant win game may be offered in different purchase denominations, or other necessary or desire identification information. The records may further include audit control and security information for verifying the integrity of the outcomes and the instant win game. Such information may include a control number for tracking the outcomes, such as a timestamp or other unique identifier, identification of the pool and/or component of the lottery network 100 from which the outcome was drawn, or any other information for tracing and confirming the validity of the outcome record as the record is processed in the lottery network 100.

As part of the process of selecting the instant win game outcomes, accounting and control information, and other security information for the instant win game may be updated. The information in the lottery network 100 may be updated to reflect the selection of the outcome records from the pool and the issuance of outcomes to the player terminal unit 190 and, consequently, to the player. The outcome record within the pool may be updated to reflect the selection of the outcome and to prevent the outcome record from being selected a second time. If desired or necessary, the outcome record may further be updated with identification information relating to the player terminal unit 190 at which the outcome record was purchased, and relating to the player to which the outcome was sold. Other necessary accounting information necessary for administering the instant win game may also be update where necessary within the lottery network 100.

After the outcomes are selected and any necessary accounting and control information is updated, control may pass to a block 258 wherein the outcome records may be processed by the player terminal unit 190 and evaluated to determine whether the outcomes are winning or losing outcomes. The format of the outcome records may dictate the amount of processing required to convert the information from the outcome records into the corresponding outcomes for the instant win game. Where information corresponding to the symbols for the instant win game is stored in the outcome record, the player terminal unit 190 may only be required to look up the symbols and compare the combination of symbols to predetermined winning combinations of symbols to determine whether the outcome is a winning outcome. In some implementations, the outcome record may include an identifier for the corresponding record in the outcome pool, and the controller 200 of the player terminal unit 190 may transmit a request for the outcome to the device at which the pool is stored, with the device responding with additional information for the outcome. Still further, where the outcome record contains a seed such as a random number generator seed as discussed above, the controller 200 may input the seed into the random number or other outcome generating software to generate the corresponding outcome for the instant win game. Other methods for converting an outcome record from a pool of outcome records into the actual outcome for a wagering game are known in the art and are contemplated as having use in the electronic instant win game in accordance with the present invention.

Once the outcome records are selected, processed and evaluated, control may pass to a block 260 where the player terminal unit 190 may print the results of the purchased outcomes on a multi-outcome ticket at the ticket printer 218. The controller 200 may use the outcomes to format the multi-outcome ticket and transmit the formatted ticket to the ticket printer 218 for printing. In one embodiment, the ticket printer 218 may print onto a fixed-size ticket stock stacked in and fed through the printer 218. The ticket stock may be sized large enough to accommodate printing the results of a maximum number of outcomes that may be purchased by a player at the player terminal unit 190, or may be sized smaller such that a relatively small number of outcomes may be printed on one piece of ticket stock and larger numbers of outcomes may be printed across multiple pieces of ticket stock. In another embodiment, the ticket printer 218 may print information on paper from a continuous roll of paper stock, and perforate or sever the paper to separate the printed ticket from the roll after the information for the ticket is printed on the leading portion of the roll. Configured in this manner, each multi-outcome ticket may be sized according to the information to be conveyed for the number of outcomes purchased by the players instead of using a fixed-size ticket stock that may or may not accommodate the number of outcomes purchased by the players.

Figure 5:
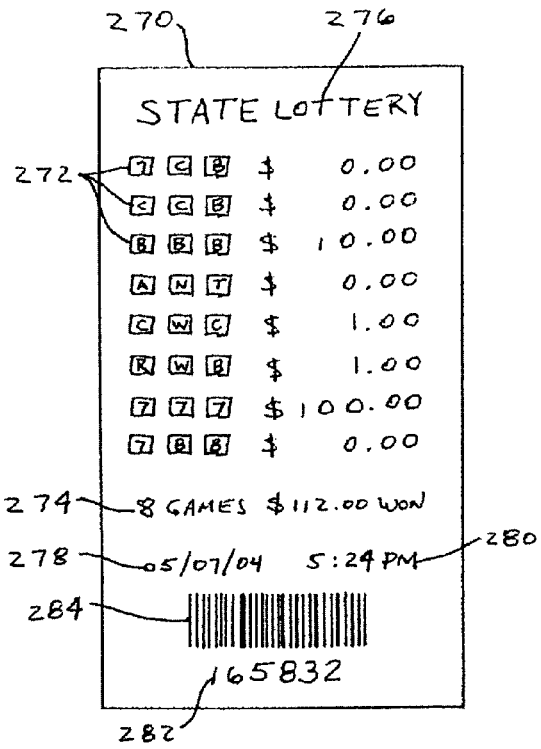
FIG. 5 is an illustration of an embodiment of a multiple outcome ticket for an electronic instant win game that may be printed by the units of the networked lottery system of FIG. 1.

The multi-outcome tickets may include as much or as little detail regarding each of the outcomes of the instant win game as the game sponsor desires to provide. FIGS. 5-8 illustrate several embodiments of multi-outcome tickets providing differing levels of detail about the outcomes of the instant win game. Referring to FIG. 5, a multi-outcome ticket 270 may present one line of detail for each outcome of the instant win game purchased by a player. In the illustrated example, the instant win game may an electronic pull-tab or scratch-off game simulating a slot machine having three reels and a single payline, with the outcome being determined based on the combination of symbols appearing in the reel stop positions along the payline. For each purchased outcome of the instant win game, a line of individual outcome indicia 272 may be printed on the multi-outcome ticket 270. Each line of individual outcome indicia 272 may include, for example, symbols corresponding to the reel stop positions of the simulated slot machine, and an indication of whether the outcome is a winning outcome in the form of the award amount corresponding to the reel stop positions. For the first line of individual outcome indicia 272, the combination of a "7," a "C" or cherry symbol and a "B" or bar symbol may be a losing outcome resulting in no award as indicated by the "$0.00" award amount. Conversely, the third line of individual outcome indicia 272 illustrates a winning combination of three "B" or bar symbols resulting in a "$10.00" award amount as printed on the ticket, and the fifth and sixth lines of individual outcome indicia 272 illustrate winning outcomes due to the occurrence of "W" or wildcard symbols on the payline resulting in "$1.00" awards.

In addition to the individual outcome indicia 272, the ticket 270 may be printed with other indicia providing information for the players and for the game sponsor. The ticket 270 may include transaction summary indicia 274 that may include a summary of the number of game outcomes purchased by the player and the total award amount won by the player from the purchased outcomes. Further, the ticket 270 may include other identification, such sponsor identification indicia 276, and control indicia for managing the instant win game and verifying the outcomes, such as date indicia 278, time indicia 280, transaction identification indicia, such as a transaction number 282, and computer readable indicia, such as a bar code 284 with information relating to the transaction and that may be read by a device such as play slip/ticket readers 131, 222 to retrieve information about the outcome purchase transaction.

Figure 6:
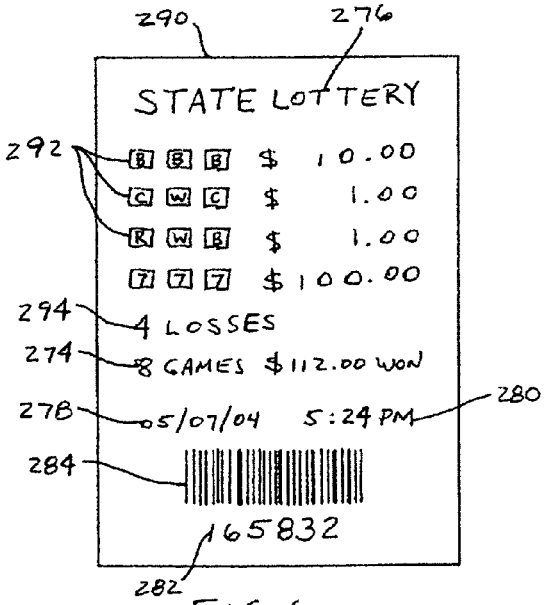
FIG. 6 is an illustration of an alternative embodiment of a multiple outcome ticket for an electronic instant win game that may be printed by the units of the networked lottery system of FIG. 1.

As previously mentioned, the multi-outcome tickets may have more or less information depending on the preferences of the game sponsor. FIG. 6 illustrates an embodiment of a multi-outcome ticket 290 wherein individual results may be provided on the multi-outcome ticket 290 for each winning outcome, and a summary may be provided for the losing outcomes. Winning outcome indicia 292 on the ticket 290 may be similar to the individual outcome indicia 272 of the ticket 270 and include symbols corresponding to the outcome of the instant win game, and an indication of whether the outcome is a winning outcome in the form of the award amount corresponding to the outcome. However, unlike the ticket 270, the ticket 290 may include losing outcome summary indicia 294 that may be an indication of the number of instant win game outcomes purchased that were losing outcomes and, correspondingly, result in no awards for the player. Other identification and control indicia 274-284 similar to the corresponding indicia of the ticket 270 may also be printed on multi-outcome ticket 290.

Figure 7:
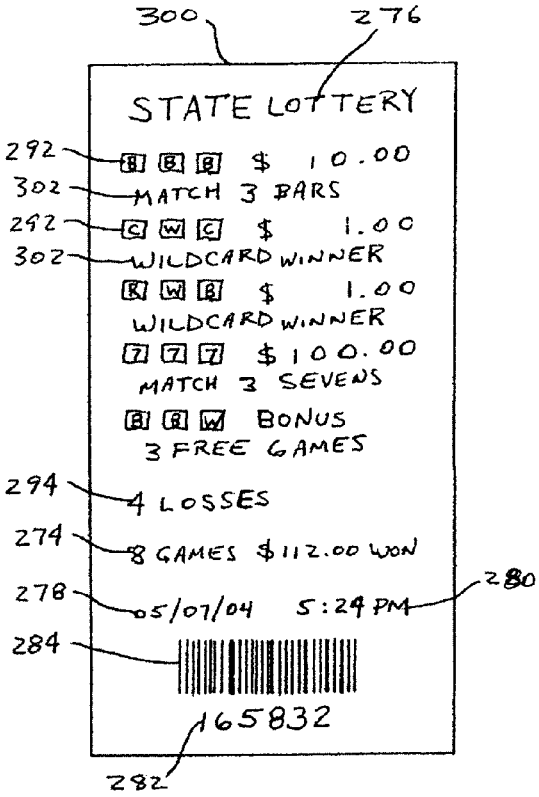
FIG. 7 is an illustration of a further alternative embodiment of a multiple outcome ticket for an electronic instant win game that may be printed by the units of the networked lottery system of FIG. 1.

Referring to FIG. 7, a multi-outcome ticket 300 may include additional information or explanation for each of the winning outcomes. In the illustrated embodiment, each winning outcome indicia 292 may have corresponding explanatory indicia 302 printed on the ticket 300. The explanatory indicia 302 may provide a description of how the combination of symbols shown in the winning outcome indicia 292 resulted in the outcome being a winning outcome (e.g., "MATCH 3 BARS," "MATCH 3 SEVENS," "WILD CARD WINNER"). The explanatory indicia 302 may also provide information relating to alternate or additional awards for the player as a result of a particular winning outcome (e.g., "WIN 3 FREE GAMES"). In the illustrated example, the combination of two "B" or bar symbols and a "7" symbol may result in the player being awarded three free games or outcomes for the instant win game. As a result of the player receiving this outcome, the lottery network 100 may have selected and processed three additional outcomes of the instant win game, and the winning outcome indicia 292, losing outcome summary indicia 294 and transaction summary indicia 274 may reflect the results of the additional outcomes. As previously discussed, multi-outcome tickets 270, 290, 300 are exemplary. Other combinations and presentations of the information relating to the outcomes of multiple instant win game outcomes and associated transaction information will be apparent to those skilled in the art and are contemplated as having use in accordance with the invention.

Referring back to FIG. 5, after the multi-outcome tickets are printed, or contemporaneously therewith, control may pass to a block 262 wherein value equivalent to the cumulative amount of the awards won by the player from the purchased outcomes of the instant win game. The player terminal units 190 may be configured to dispense value to players in any acceptable form as dictated by the game sponsor. Value may be dispensed in the form of paper and/or coin currency dispensed from the currency dispenser(s) 226 of the player terminal unit 190. Value may also be dispensed to the player in the form of the multi-outcome ticket printed and dispensed at ticket printer 218, which may be in the form of a paper coupon or voucher that may be redeemable for cash, or for goods or services offered by the game sponsor or its affiliates in an amount equivalent to the award or awards won by the players from the instant win game outcomes. For example, the bar code 284 of the multi-outcome ticket may include information for the total award value won by the player, or other information, such as the transaction number, that may correspond to information stored in the lottery network 100 indicating the value due the player or bearer of the multi-outcome ticket. The player or bearer of the ticket may be required to present the ticket to a sales agent, cashier, value redemption terminal or other component of the lottery network 100 in order to claim the value of the awards from the purchased instant win game outcomes. As a further alternative, value may be dispensed in the form of monetary credit or game credits that may be stored in the player's information on a player tracking system of the lottery network 100. A plurality of these and other for value dispensing options may be provided to the players, with the player's being capable of input selections regarding the form in which to receive the value of the awards won for the outcomes of the instant win game.

The flow of the purchase game outcomes routine 250 is exemplary only, and the steps may be performed in any order necessary to complete the purchase transaction, or additional steps may be performed if necessary to implement the instant win game. As previously discussed, the multi-outcome ticket print routine 250 may be modified depending on the particular implementation of the instant win game and the lottery network 100. For example, the instant win game may be implemented such that the players may purchase instant win game outcomes from sales agents at the lottery terminal units 104. During the purchase transaction, the player may approach the sales agent and request to purchase a desired number of outcomes for the instant win game. The sales agent may enter the player's game option selections at the lottery terminal unit 104, or insert a completed play slip provided by the player into the play slip/ticket reader 131, and accept payment for the outcomes from the player. The lottery terminal unit 104 may then cause the selection and processing of the requested number of outcomes, and cause the ticket printer 132 to print a multi-outcome ticket for the player. The sales agent may then pay the player the amount of any awards from the outcomes, and the multi-outcome ticket may serve as the player's receipt for the transaction. In other embodiments, the instant win game may be implemented using portable storage devices in the manner taught in the previously identified and incorporated co-pending patent application. In such implementations, the multi-outcome tickets may be printed at the terminal units at which a player redeems the instant win game outcomes stored on the portable storage device either as a receipt of as an instrument to be turned in and exchanged for the awards won by the player.

Displaying Multiple Instant Win Game Outcomes

Alternatively or in addition to printing a multi-outcome ticket as discussed above, the lottery network 100 may provide a graphical display of multiple instant win game outcomes purchased by a player. The graphical display may be informational, or may provide a simulation to the player of playing the instant win game or other wagering game or event having an outcome corresponding to the purchased outcomes of the instant win game. The graphical display may be provided to the players at the display 214 of the player terminal unit 190, or at other devices of the lottery network 100 at which players may purchase and play outcomes of the instant win game.

Figure 8:
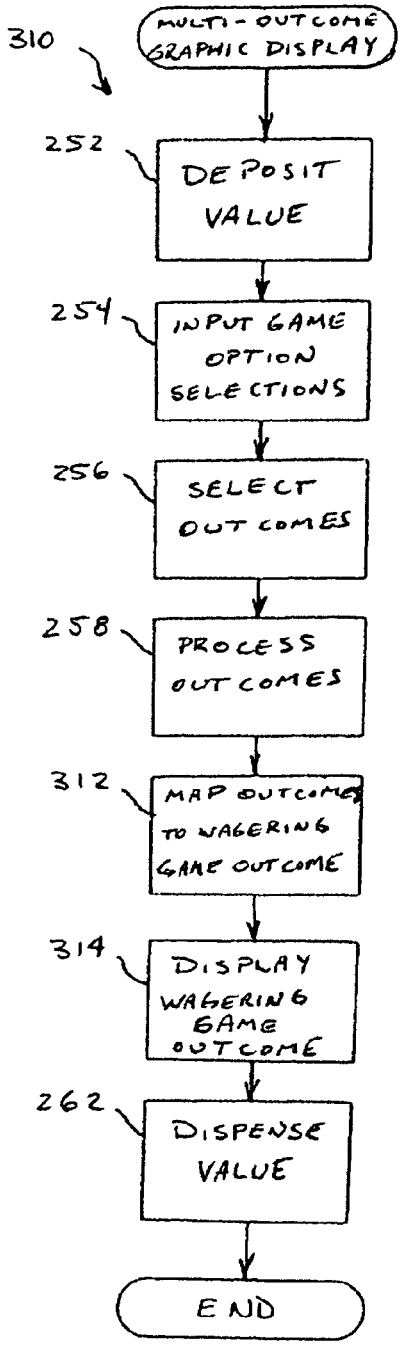
FIG. 8 is a flowchart of an embodiment of a multiple outcome graphic display routine for an electronic instant win game.

FIG. 8 illustrates an embodiment of a multi-outcome graphic display routine 310 that may occur in the lottery network 100 to allow a player to purchase game outcomes and have the outcomes displayed. The routine 310 may begin in a similar manner described for the multi-outcome ticket print routine 250 with a player depositing value at block 252 and inputting game option selections at block 254. The routine 310 may then continue with the selection of outcomes at block 256 and processing of the selected outcomes at block 258. After the outcomes are selected and processed, the controller 200 of the player terminal unit 190 may map the outcomes to a graphical display at a block 312 and cause the display 214 to display the graphical display of the outcomes to the player at a block 314. Once the player views the graphical display of the outcomes and concludes the purchase transaction, control may pass to block 262 where the player terminal unit 190 or other component of the lottery network 100 dispenses value to the user corresponding to any awards won by the player as discussed above.

The graphical display of the instant win game outcomes may be presented in any form desired by the game sponsor. In one embodiment, the graphical display may be informational and may be in a format similar to the layout of the multi-outcome tickets 270, 290, 300 discussed above and presented at the display 214 of the player terminal unit 190. The controller 200 may be programmed to format the display to include information for all of the purchased outcomes on the display 214 at one time, of the controller 200, display 214 and control panel 212 may be configured to show the outcomes on a plurality of screens and allow the player to enter input to navigate through the screens to view all of the results. The display may simulate the playing of the instant win game by initially covering the symbols of the outcomes, and allowing the player to make selections at the control panel 212 or display 214 causing the display 214 to reveal the symbols in a manner simulating the opening of pull-tabs or scratching off the covering material of a scratch-off ticket.

In an alternative embodiment, the player terminal unit 190 may be configured to display a plurality of instant win game outcomes in the form of a single outcome of another wagering game, such as a video slot machine or video poker game. After the instant win game outcomes are selected and processed, the controller 200 may map the outcomes of the instant win games to an outcome of the displayed wagering game at block 312, and cause the display 214 to display the single outcome of the displayed wagering game corresponding to the plurality of instant win game outputs at block 314. The display of the wagering game outcome may be such that the player terminal unit 190 simulates the playing of the wagering game to enhance the player's experience of playing the instant win games. For example, the player terminal unit 190 may simulate a slot machine in both appearance and flow of the game. The cabinet of the player terminal unit 190 may have the appearance of a slot machine, and the graphics displayed at display 214 may simulate the graphics of a known slot machine, including the appearance of the slot reels, the provision of similar button images for player selections if the display 214 is a touch screen, and the display of additional graphics contributing to the experience of playing the slot machine. While the graphical display may simulate a slot machine or other wagering game, it is understood that the outcome of the simulated wagering game is determined based on the outcomes of the instant win game selected at block 256.

Figure 9:
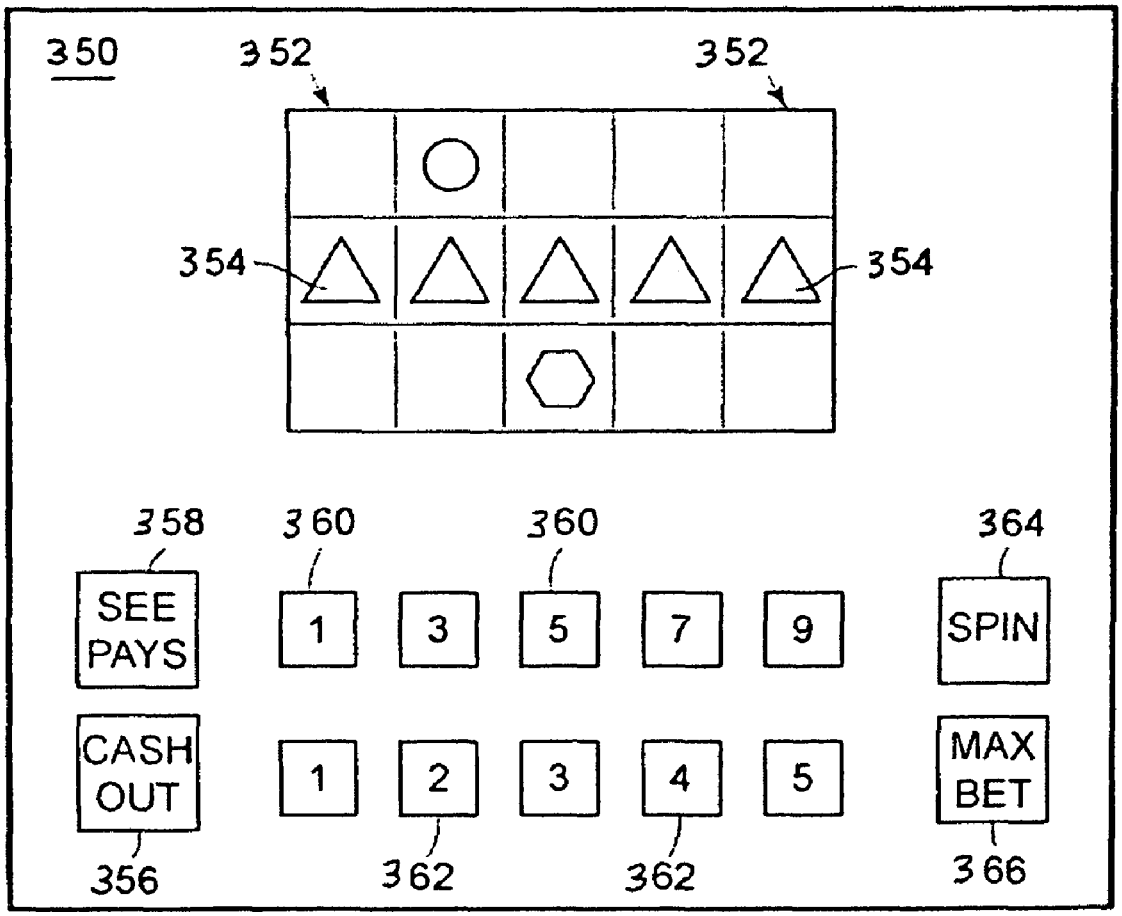
FIG. 9 is an illustration of an embodiment of a graphical display for multiple outcomes of an electronic instant win game as a single outcome of a video slot game that may be displayed by the units of the networked lottery system of FIG. 1.

FIG. 9 illustrates one embodiment of a multi-outcome graphical display in the form of a video slot game display 350 simulating a five-reel slot machine. The video slot game display 350 may include video images 352 of a plurality of slot machine reels, each of the reels having a plurality of reel symbols 354 associated therewith. Although the display 350 shows five reel images 352, each of which may have three reel symbols 354 that are visible at a time, other reel configurations could be utilized. If desired by the instant win game sponsor to allow the player to control the play of the instant win game via a simulation of the game play of the displayed slots game, a plurality of player-selectable buttons may be displayed. The buttons may include a "Cash Out" button 356, a "See Pays" button 358, a plurality of payline-selection buttons 360 each of which may allow the player to select a different number of paylines prior to "spinning" the reels 352, a plurality of bet-selection buttons 362 each of which allows a player to specify a wager amount for each payline selected, a "Spin" button 364, and a "Max Bet" button 366 to allow a player to make the maximum wager allowable. The use of the buttons 356-366 by the player to player the instant win game via the simulated slot machine is discussed further below.

Figure 10:
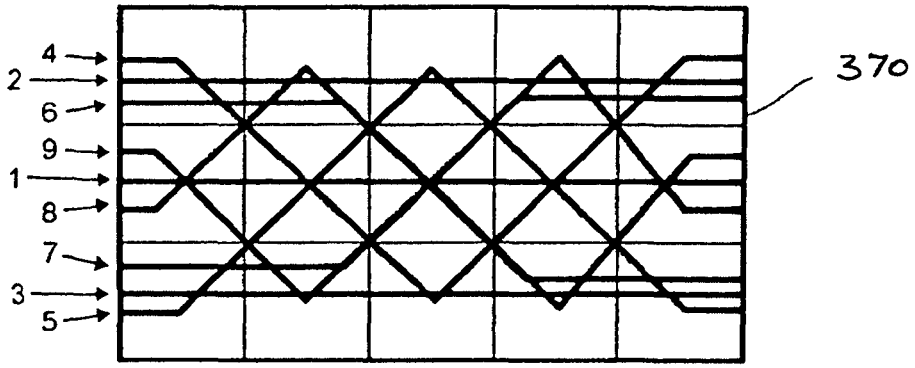
FIGS. 10 and 11 illustrate an embodiment of the multiple paylines corresponding to the video slots display of FIG. 9, along with illustrations of the individual paylines.
Figure 11:
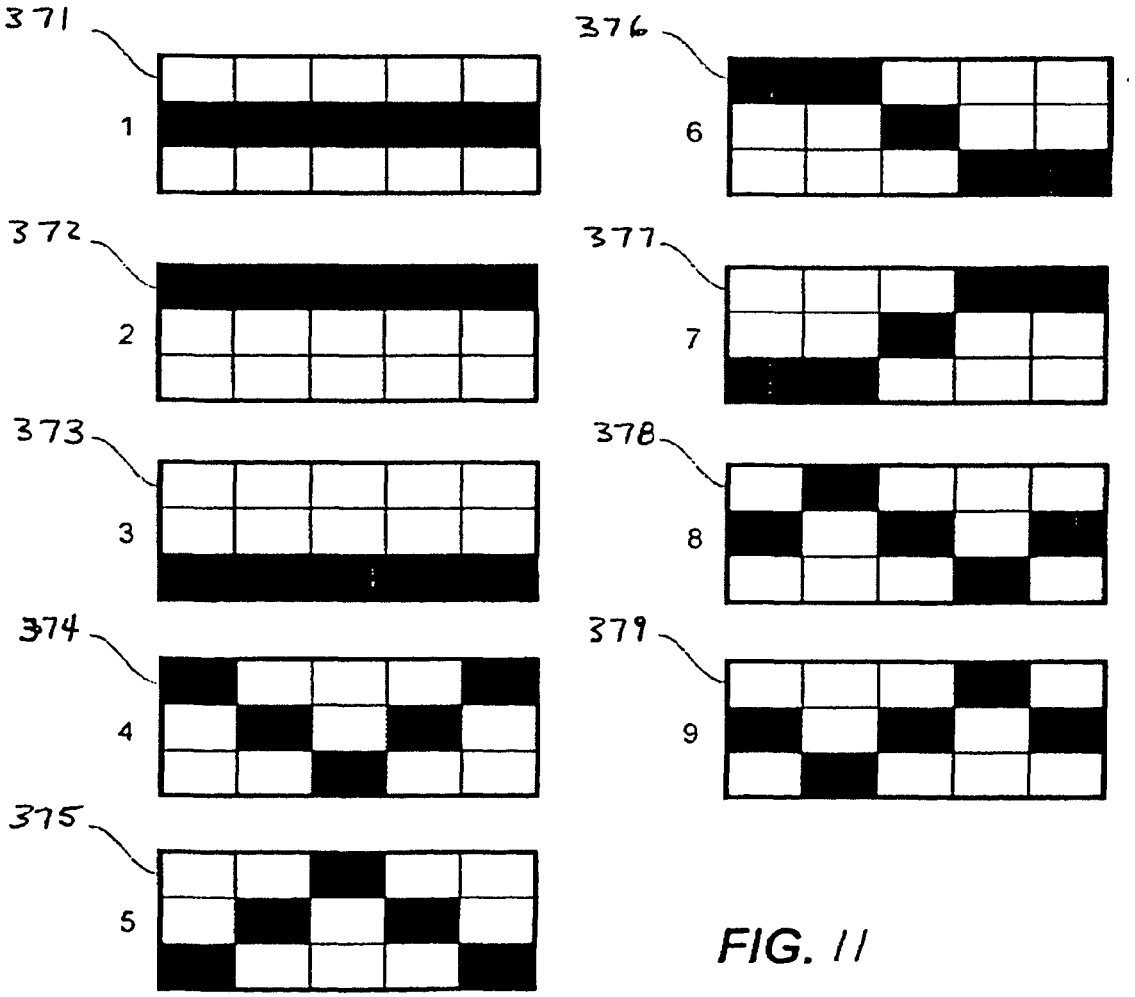

The display 350 may correspond to a five-reel slot machine having three stop positions per reel such that 15 symbols are displayed as shown in FIG. 9. As shown in FIG. 10, the simulated reels 370 of the slot machine includes nine paylines that may be used to map outcomes of the instant win game to the simulated slot game, and the manner in which the simulated slot game is displayed may be based on selections made using buttons 360 as discussed further below. FIG. 11 illustrates each of the individual paylines 371-379 on which winning combinations of symbols 354 may appear for the purpose of clarity. In the actual slot game, each of the paylines 371-379 on which a player wagers is evaluated to determine whether the symbols on the reels match any of the predefined combination of reel symbols for which a prize is awarded when the reels are spun and stop. More than one payline may include a winning combination of reel symbols, and the award amounts for multiple paylines may be added to determine a total award amount for the reel spin.

At block 312, the controller 200 of the player terminal unit 190 may map a plurality of outcomes of the instant win game to a single outcome of the slot machine consisting of a combination of reel symbols 354 on the reels 352 along one or more paylines 371-379 resulting in an award equal to the combined award for the plurality of outcomes. The controller 200 may be configured in any desired manner such that the results of the selected outcomes of the instant win game are converted into a corresponding outcome of the simulated wagering game. In one embodiment, the cumulative result or award for a plurality of purchased outcomes for the instant win game may be used to select a corresponding outcome of the simulated wagering game for display to the player. The player terminal unit 190 may store one or more outcomes for the simulated wagering game corresponding to each possible cumulative award amount that may be won by a player purchasing a plurality of instant win game outcomes.

Figure 12:
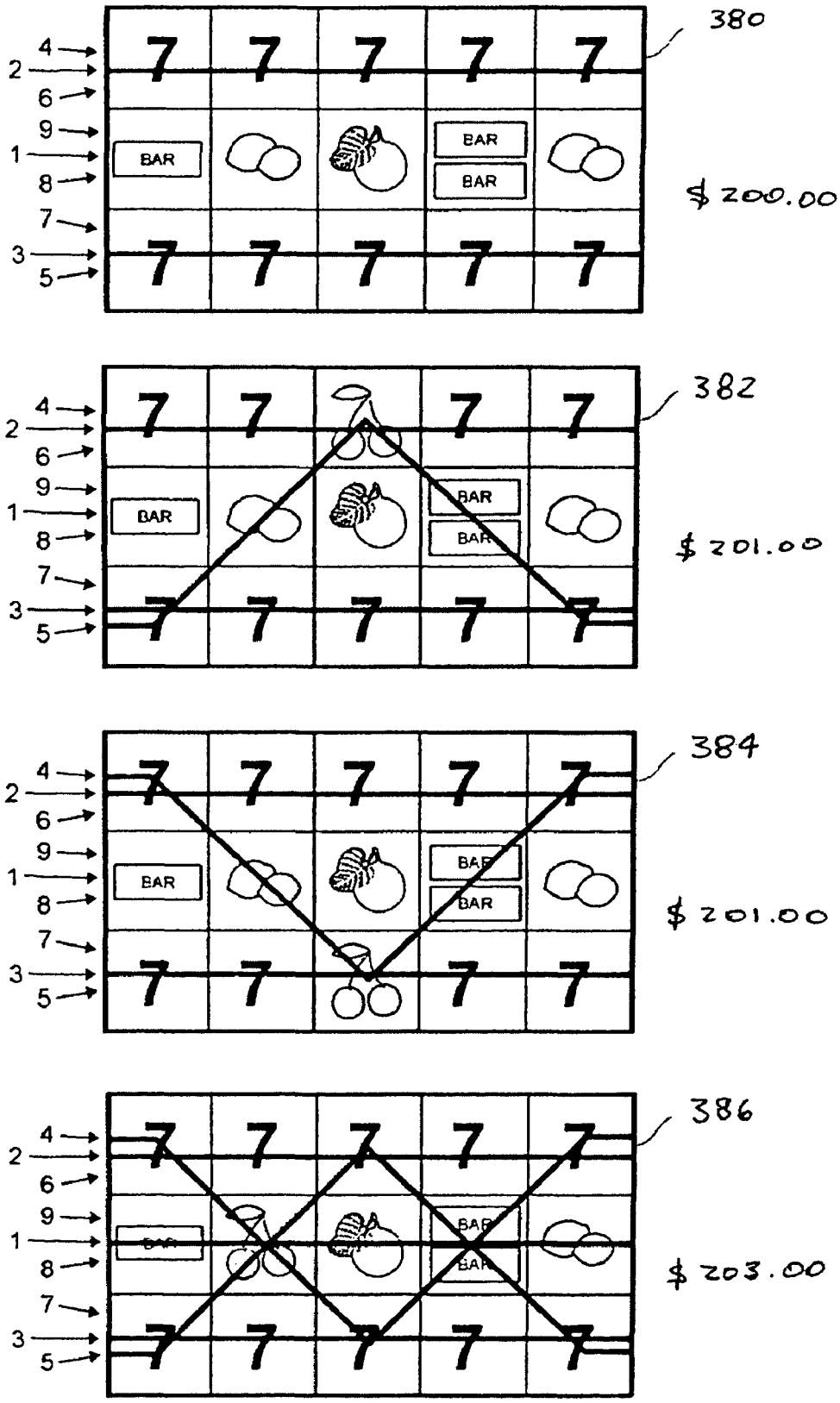
FIG. 12 is an illustration of possible slot machine reel stop positions and symbol combinations corresponding to various award amounts

Referring to FIG. 12, exemplary slot game outcomes 380-386 are illustrated that may be used in the simulated wagering game to present a single outcome corresponding to a plurality of outcomes of the instant win game. Slot game outcome 380 includes combinations of five 7's on paylines 2 and 3 that may correspond to a $200.00 award amount. Slot game outcomes 382 and 384 may both correspond to $201.00 award amounts, with combinations of five 7's on one payline, four 7's and cherry or wildcard on another payline, and the cherry or wildcard falling along a third payline. Slot game outcome 386 corresponding to a $203.00 award amount may be similar to slot game outcome 380 with the addition of a cherry or wildcard falling along three additional paylines (1, 4 and 5). Similar slot game outcomes corresponding to the same award amounts and to other possible award amounts may be stored at the player terminal unit 190, including a plurality of slot game outcomes that are losing outcomes such that duplicate losing slot game outcomes are displayed relatively infrequently at a given player terminal unit 190.

In the present embodiment, the slot game outcomes 380-386 among other outcomes may be stored at the player terminal units 190 along with the corresponding award amounts as indicated. After the purchased outcomes are processed at block 258, the controller 200 may sum the award amounts for the purchased outcome and select one of the stored simulated wagering game outcomes with an award amount corresponding to the cumulative award amount. For example, if the award amounts for the purchased outcomes total $200.00, either based on a single winning outcome or multiple winning outcomes, the controller 200 may select slot game outcome 380 from the $200.00 slot game outcomes stored at the player terminal unit 190. The controller 200 may cause the display 214 to provide an animated display of the reels 452 spinning and stopping with the combination of symbols 354 of slot game outcome 380 being displayed on the reels 352 of the display 350. Similarly, if the award amounts for the purchased outcomes total $201.00, the controller 200 may select one of the slot game outcomes 282, 284 or another $201.00 outcome and cause the selected slot game outcome to be displayed by the display 214.

In alternative embodiments, the controller 200 may be programmed with an algorithm for determining combinations of symbols and reel stop positions corresponding to the purchased outcomes of the instant win game in lieu of storing predetermined slot game outcomes as discussed in the preceding embodiment. Depending on the implementation of the instant win game and the configuration of the algorithm, the purchased outcomes for the instant win game may be input for the algorithm collectively or individually in order to determine a single corresponding outcome for the simulated wagering game. In one embodiment, the award amounts for the purchased outcomes may be summed by the controller 200 and input into the algorithm to determine a combination of symbols 354 on the reels 352 corresponding to the cumulative award amount for the purchased outcomes of the instant win game. The algorithm may be configured to such that a plurality of outcomes for the simulated wagering game may be determined for a particular cumulative award amount for the instant win game. The particular simulated wagering game outcome may be determined based on other information input to the algorithm, such as a counter or a random number generator like a timestamp, to ensure that the same simulated wagering game outcome does not occur consecutively, or at least does so coincidentally.

In a further alternative embodiment, the controller 200 may be programmed to map a plurality of purchased outcomes for the instant win game to a single outcome of the simulated wagering game such that each instant win game is independently identifiable within the single simulated wagering game outcome. In one implementation, each purchased outcome of the instant win game may correspond to one of the paylines 371-379 of the simulated reel display 370. When a player purchases outcomes of the instant win game, a number of outcomes of the instant win game equal to the number of paylines 371-379 of the simulated reel display 370 may be selected at block 354, or the player may be able to specify a number of instant win game outcomes to purchase up to the number of paylines 371-379 when inputting game selection information at block 254. Regardless of the specific method for mapping the instant win game outcomes to the outcome of the simulated reel display 370, each outcome may be identifiable by evaluating the corresponding one of the paylines 371-379.

Where the outcomes of the simulated wagering game are stored at the player terminal unit 190, one or more wagering game outcomes may be stored for each possible combination of instant win game outcomes. After the instant win game outcomes are processed at block 258, the controller 200 may use the results of each outcome to select one of the wagering game outcomes to be displayed at the display 214. For example, the $200.00 slot game outcome 380 may correspond to a player's purchase of three or more instant win game outcomes in which the second and the third outcomes are both $100.00 winning outcomes, and the remaining outcomes are losing outcomes. The slot game outcome 380 may be selected by the controller 200 from the available wagering game outcomes and displayed by the display 214. Similarly, the $201.00 slot game outcomes 382, 384 may correspond to at least five purchased instant win game outcomes in which the second and third outcomes are $100.00 winning outcomes, either the fourth outcome (slot game outcome 384) or the fifth outcome (slot game outcome 382) is a $1.00 winning outcome, and the remaining outcomes are losing outcomes. Alternatively, the slot game outcomes may be selected from the stored outcomes based on the number of winning outcomes for each award amount without regard to the order in which the instant win game outcomes were selected. In such an implementation, either slot game outcome 382 of 384 may be selected where two instant win game outcomes are $100.00 winning outcomes and one outcome is a $1.00 winning outcome.

Each of the purchased instant win game outcomes may also be mapped to a single simulated wagering game outcome via a mapping algorithm as discussed above. After the purchased outcomes are processed, the controller 200 may input the winning outcomes and, if the algorithm is so configured, the total number of purchased outcomes and/or the order of selection of the outcomes into the mapping algorithm for determination of a corresponding slot game outcome. As with the stored slot game outcomes discussed above, the algorithm may take into account the order in which the instant win game outcomes were selected such that each outcome corresponds to a particular one of the paylines 371-379 based on the order in which the instant win game was selected, or the algorithm may be configured to solely take into account the award amounts and numbers of winning outcomes.

As previously discussed, the simulated slot game display 350 may include buttons 356-366 further simulating the slot machine and controlling the player's purchasing of instant win game outcomes. The "Cash Out" button 356 may allow a player to terminate the purchase transaction or session at the player terminal unit 190. When the player actuates the "Cash Out" button 356, control may pass to the block 262 where the player terminal unit 190 may dispense value to the player if the player currently has a credit balance to be dispensed. Actuation of the "See Pays" button 358 may cause the display 214 to display combinations of symbols resulting in winning outcomes for the simulated wagering game. The player terminal unit 190 may further be configured to cause the display 214 to display combinations of symbols resulting in winning combinations for the instant win game, either on a separate display or concurrently with the simulated wagering game outcomes. Subsequent actuation of the "See Pays" button 358 may cause the display 214 to return to the display of the simulated wagering game.

The buttons 360-366 may be provided to allow the player to input the game option selections at block 254 and initiate the selection of the outcomes of the instant win game at block 256. The payline selection buttons 360 may be used by the player to determine the number of paylines on which the player may match symbols 354 and, correspondingly the number of occurrences of the instant win game to be selected for the occurrence of the simulated wagering game. The bet-selection buttons 362 may be used to select an amount to be paid for each payline/instant win game outcome. Depending on the implementation, wagering a higher bet amount may result in correspondingly higher award amounts, or greater wager amounts may correspond to different instant win game having greater potential awards to be won by the players. Once the player selects the number of outcomes to purchase and the amount to wager per outcome, actuation of the "Spin" button 364 may cause control to pass to block 256 where the specified number of outcomes may be selected, and the display 214 may graphically display the reels 352 beginning to spin. Alternatively, the "Max Bet" button 366 may allow the player to expedite playing the instant win game by allowing the player to elect to purchase the maximum number of paylines/instant win game outcomes for the maximum wager amount/purchase price, and have control pass to the block 256 for selection of the instant win game outcomes.

While the simulated wagering game has been illustrated and described herein as a simulated slot game, those skilled in the art will understand that other wagering games may be simulated with the outcome of the simulated wagering game corresponding to a plurality of outcomes of an instant win game. For example, the simulated wagering game may be a multi-play draw poker game wherein a plurality of poker hands are displayed at display 214, each corresponding to one of the selected outcomes of the instant win game. Various methods are known in the art for mapping an outcome from the finite pool of outcomes to a draw poker game such that a player may be dealt an initial poker hand, the player may make selections for holding and discarding cards from the hand, and the cards in the hand may be replaced and/or manipulated such that the final poker hand corresponds to the outcome from the finite pool regardless of the selections made by the player. Where multiple poker hands are displayed corresponding to multiple instant win game outcomes, each poker hand may initially contain the same combination of playing cards. The discard selections made by the player may be applied to each of the displayed poker hands, and each displayed poker hand may be filled out with playing cards such that each final poker hand corresponds to the underlying instant win game outcome. In a similar manner, simulated outcomes of other wagering games such as video blackjack, video keno and the like may be used to simulate the results from a plurality of instant win game outcomes.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A player terminal unit for conducting an electronic wagering game in a gaming network having a plurality of player terminal units wherein each player may purchase a plurality of outcome records from a finite pool of outcome records, the player terminal unit comprising:

an input device for inputting a plurality of input selections;

a currency-accepting mechanism that is capable of allowing a player to deposit a medium of currency;

a video display device; and a controller operatively coupled to the input device, the currency-accepting mechanism and the display device, the controller being programmed to allow the currency-accepting mechanism to accept a deposit of an amount of the medium of currency by a player at the player terminal unit, the controller being programmed to allow the input device to receive input for game option selections from the player to purchase outcomes for a first wagering game, the controller being programmed to cause a selection device of the gaming network to select outcome records from the finite pool of outcome records corresponding to a number of outcomes requested by the player in response to receiving input for the game option selections by the player at the input device, the controller being programmed to determine whether each of the selected outcome records corresponds to a winning outcome or a losing outcome, and the controller being programmed to cause the display device to display the outcomes of the plurality of selected outcome records for the first wagering game to the player in the form of a predetermined combination of graphical outcomes of a second wagering game which simulates play of the second wagering game, wherein the predetermined combination of graphical outcomes of the second wagering game corresponds to the outcomes of the selected outcome records of the first wagering game such that each result of the selected outcome records of the first wagering game is independently identifiable as a winning or losing outcome within the predetermined combination of graphical outcomes of the second wagering game.

2. A player terminal unit for conducting an electronic wagering game according to claim 1, further including a printing device, and wherein the controller is programmed to cause the printing device to print a ticket with information corresponding to the outcomes of the selected outcome records.

3. A player terminal unit for conducting an electronic wagering game according to claim 2, wherein the controller is programmed to cause the printing device to print information for each winning outcome of the selected outcome records on at least one separate line on the ticket.

4. A player terminal unit for conducting an electronic wagering game according to claim 3, wherein the controller is programmed to cause the printing device to print explanatory information for each winning outcome of the selected outcome records on the ticket.

5. A player terminal unit for conducting an electronic wagering game according to claim 2, wherein the controller is programmed to cause the printing device to print information for each losing outcome of the selected outcome records on at least one separate line on the ticket.

6. A player terminal unit for conducting an electronic wagering game according to claim 2, wherein the controller is programmed to cause the printing device to print summary information for the losing outcomes of the selected outcome records on the ticket.

7. A player terminal unit for conducting an electronic wagering game according to claim 2, wherein the controller is programmed to cause the printing device to print graphical images corresponding to the outcomes of the selected outcome records on the ticket.

8. A player terminal unit for conducting an electronic wagering game according to claim 1, wherein the controller is programmed to select the outcomes of the second wagering game from a plurality of stored outcomes of the second wagering game based on the outcomes of the selected outcome records.

9. A player terminal unit for conducting an electronic wagering game according to claim 1, wherein the controller is programmed to determine the outcomes of the second wagering game based on the outcomes of the selected outcome records.

10. A player terminal unit for conducting an electronic wagering game according to claim 9, wherein the controller is programmed to input information regarding the outcomes of the selected outcome records into an algorithm to determine the outcomes of the second wagering game.

11. A player terminal unit for conducting an electronic wagering game according to claim 1, wherein the second wagering game is a video slot game.

12. A player terminal unit for conducting an electronic wagering game according to claim 11, wherein the video slot game has multiple paylines and each selected outcome record corresponds to one of the paylines, the controller being programmed to cause the video display device to display a combination of symbols on each payline of the video slot game resulting in an outcome of the video slot game corresponding to the outcome of the selected outcome record corresponding to the payline.

13. A player terminal unit for conducting an electronic wagering game according to claim 1, wherein the selection device of the gaming network is the player terminal unit.

14. A method for conducting an electronic wagering game at a gaming network, comprising:

receiving value from a player via a value-accepting mechanism;

receiving game option selections for a first wagering game from the player via an input device;

selecting, by use of a programmed controller, a plurality of outcome records for the first wagering game from a finite pool of outcome records for the first wagering game based on the game option selections from the player;

determining, by use of the programmed controller, whether each selected outcome record is a winning outcome or a losing outcome for the first wagering game; and displaying a graphical display of the outcomes of the plurality of selected outcome records for the first wagering game to the player at a display device in a predetermined combination of graphical outcomes of a second wagering game which simulates play of the second wagering game, wherein the predetermined combination of graphical outcomes of the second wagering game corresponds to the outcomes of the selected outcome records of the first wagering game such that each result of the selected outcome records of the first wagering game is independently identifiable as a winning or losing outcome within the predetermined combination of graphical outcomes of the second wagering game.

15. A method for conducting an electronic wagering game according to claim 14, wherein displaying the outcomes further comprises printing information corresponding to the outcomes of the selected outcome records on a ticket.

16. A method for conducting an electronic wagering game according to claim 15, comprising printing information for each winning outcome of the selected outcome records on at least one separate line on the ticket.

17. A method for conducting an electronic wagering game according to claim 16, comprising printing explanatory information for each winning outcome of the selected outcome records on the ticket.

18. A method for conducting an electronic wagering game according to claim 15, comprising printing information for each losing outcome of the selected outcome records on at least one separate line on the ticket.

19. A method for conducting an electronic wagering game according to claim 15, comprising printing summary information for the losing outcomes of the selected outcome records on the ticket.

20. A method for conducting an electronic wagering game according to claim 15, comprising printing graphical images corresponding to the outcomes of the selected outcome records on the ticket.

21. A method for conducting an electronic wagering game according to claim 14, comprising selecting the outcomes of the second wagering game from a plurality of stored outcomes of the second wagering game based on the outcomes of the selected outcome records.

22. A method for conducting an electronic wagering game according to claim 14, comprising determining the outcomes of the second wagering game based on the outcomes of the selected outcome records.

23. A method for conducting an electronic wagering game according to claim 22, comprising inputting information regarding the outcomes of the selected outcome records into an algorithm to determine the outcomes of the second wagering game.

24. A method for conducting an electronic wagering game according to claim 14, wherein the second wagering game is a video slot game.

25. A method for conducting an electronic wagering game according to claim 24, wherein the video slot game has multiple paylines and each selected outcome record corresponds to one of the paylines, the method comprising displaying a combination of symbols on a payline of the video slot game resulting in an outcome of the video slot game corresponding to the outcome of the selected outcome record corresponding to the payline.

26. A player terminal unit for conducting an electronic wagering game in a gaming network having a plurality of player terminal units wherein each player may purchase a plurality of outcome records from a finite pool of outcome records for a first wagering game, the player terminal unit comprising:

a currency-accepting mechanism that is capable of allowing a player to deposit a medium of currency, wherein a player may deposit an amount of the medium of currency to purchase outcomes for the first wagering game;

an input device for inputting a plurality of input selections, wherein the input device may receive input for game option selections from the player to purchase outcomes for the first wagering game;

a video display device; and a controller operatively coupled to the input device, the currency-accepting mechanism and the display device, wherein the controller causes a selection device of the gaming network to select outcome records from the finite pool of outcome records corresponding to a number of outcomes requested by the player in response to the input of game option selections by the player at the input device, wherein the controller determines whether each of the selected outcome records corresponds to a winning outcome or a losing outcome, and wherein the controller causes the display device to display the outcomes of the selected outcome records for the first wagering game to the player in a predetermined combination of graphical outcomes of a second wagering game which simulates play of the second wagering game, wherein the graphical outcome of the second wagering game corresponds to the outcomes of the selected outcome records of the first wagering game such that each result of the selected outcome records of the first wagering game is independently identifiable as a winning or losing outcome within the predetermined combination of graphical outcomes of the second wagering game.

27. A player terminal unit for conducting an electronic wagering game according to claim 26, further including a printing device, and wherein the controller causes the printing device to print a ticket with information corresponding to the outcomes of the selected outcome records.

28. A player terminal unit for conducting an electronic wagering game according to claim 27, wherein the controller causes the printing device to print information for each winning outcome of the selected outcome records on at least one separate line on the ticket.

29. A player terminal unit for conducting an electronic wagering game according to claim 28, wherein the controller causes the printing device to print explanatory information for each winning outcome of the selected outcome records on the ticket.

30. A player terminal unit for conducting an electronic wagering game according to claim 27, wherein the controller causes the printing device to print information for each losing outcome of the selected outcome records on at least one separate line on the ticket.

31. A player terminal unit for conducting an electronic wagering game according to claim 27, wherein the controller causes the printing device to print summary information for the losing outcomes of the selected outcome records on the ticket.

32. A player terminal unit for conducting an electronic wagering game according to claim 27, wherein the controller causes the printing device to print graphical images corresponding to the outcomes of the selected outcome records on the ticket.

33. A player terminal unit for conducting an electronic wagering game according to claim 26, wherein the controller selects the outcomes of the second wagering game from a plurality of stored outcomes of the second wagering game based on the outcomes of the selected outcome records.

34. A player terminal unit for conducting an electronic wagering game according to claim 26, wherein the controller determines the outcomes of the second wagering game based on the outcomes of the selected outcome records.

35. A player terminal unit for conducting an electronic wagering game according to claim 34, wherein the controller inputs information regarding the outcomes of the selected outcome records into an algorithm to determine the outcomes of the second wagering game.

36. A player terminal unit for conducting an electronic wagering game according to claim 26, wherein the second wagering game is a video slot game.

37. A player terminal unit for conducting an electronic wagering game according to claim 36, wherein the video slot game has multiple paylines and each selected outcome record corresponds to one of the paylines, and wherein the controller causes the video display device to display a combination of symbols on each payline of the video slot game resulting in an outcome of the video slot game corresponding to the outcome of the selected outcome record corresponding to the payline.

38. A player terminal unit for conducting an electronic wagering game according to claim 26, wherein the selection device of the gaming network is the player terminal unit.

* * * * *